United States Patent [19]

Niswander et al.

[11] Patent Number: 4,564,313

[45] Date of Patent: Jan. 14, 1986

[54] RECTILINEAR CULVERT STRUCTURE

[75] Inventors: Robert L. Niswander; Tomy W. Cornwell, both of Findlay, Ohio

[73] Assignee: Hyway Concrete Pipe Company, Findlay, Ohio

[21] Appl. No.: 537,337

[22] Filed: Sep. 29, 1983

[51] Int. Cl.[4] ..... E01F 5/00

[52] U.S. Cl. ..... 405/125; 249/11; 405/124

[58] Field of Search ..... 405/124, 125, 126; 249/10–12

[56] References Cited

U.S. PATENT DOCUMENTS

| | | | |
|---|---|---|---|
| 392,094 | 10/1888 | Barnes | 405/124 |
| 494,576 | 4/1893 | Lewis | 405/125 |
| 1,144,200 | 6/1915 | Hewett | 405/125 |
| 1,997,236 | 4/1935 | Schroeder | 405/125 |
| 2,041,267 | 5/1936 | Schroeder | 405/125 |
| 2,265,871 | 12/1941 | Scott | 249/12 |
| 3,693,927 | 9/1972 | Jennings | 249/11 |
| 3,696,177 | 10/1972 | Holland | 249/11 X |

FOREIGN PATENT DOCUMENTS

| | | | |
|---|---|---|---|
| 2306401 | 8/1974 | Fed. Rep. of Germany | 249/11 |

*Primary Examiner*—Dennis L. Taylor

*Attorney, Agent, or Firm*—David D. Murray

[57] ABSTRACT

A three-sided, rectilinear bridge or culvert structure comprises a pair of vertical sidewalls set in preformed or cast in place footers or existing supports and an integral, planar, horizontal span. The footers preferably include a sidewall receiving channel on their upper surfaces. There is no lower or bottom portion of the structure such as is found in conventional box culverts and thus, that region between the footers and sidewalls is open and readily permits water flow through the structure in its natural watercourse, lessening the likelihood of debris collection within the structure. The structure is cast concrete reinforced with conventional reinforcing bar or welded wire mesh. A wide range of rise/span (height/width) proportions may be accommodated in structures having spans up to about thirty feet.

24 Claims, 6 Drawing Figures

RECTILINEAR CULVERT STRUCTURE

BACKGROUND OF THE INVENTION

The invention relates generally to static structures and more particularly to a reinforced concrete bridge or culvert structure having parallel side walls interconnected by a planar horizontal top span and an open bottom.

Accompanying the development of motor vehicles and roadways designed to permit their movement rapidly and expeditiously between two points has been a similar development relating to smooth and level passage across various obstructions such as ditches, creeks, rivers and other roadways. Such structures can vary from one foot diameter pipes to suspension bridges. In what might be characterized as the smaller half of this spectrum of designs are found circular and elliptical concrete culverts, corrugated metal culverts, box culverts, concrete and metal arches and bridges constructed of conventional steel I-beams and poured, reinforced concrete, to name the more common approaches. Each such design includes features and confers benefits which make it particularly suitable for certain applications but also suffers from detriments and disadvantages which limit or prevent their utilization in other circumstances.

Precast or prefabricated construction is attractive from cost and assembly standpoints. Since such designs are typically cast in significant numbers at a single manufacturing site, the cost per unit is relatively low. Transportation to the job site, in most instances, is readily achieved by truck or rail cars and assembly is equally straightforward since dimensional tolerances are generally closely held by the casting process. Such structures, particularly the larger sizes and those fabricated of corrugated metal, however, do require carefully and properly compacted backfill in order to achieve their rated load carrying capacity. The backfill is an important consideration of the installation of the structure and must be carefully performed. These structures may also be susceptible to wash out by water flowing around the outside of the culvert and eroding supporting soil. A problem similar to that experienced with improper backfill can thus result due to the lack of appropriate support about the culvert subsequent to soil erosion.

Many of the foregoing difficulties are not shared with bridges and culverts which may be characterized as an arch type. Here, a curving, arched plate forms the upper portion of the bridge or culvert and is supported by appropriately placed footings at each end of the arch plate. In such installations over water, such as creeks and rivers, the water remains in its natural watercourse and thus erosion problems are minimized. Footing construction in this design is somewhat critical, however, since significant outward as well as downward forces must be borne by them.

A problem such arch designs share with circular and elliptical culverts however relates to internal useable height versus total height of the roadway supported by the structure. First of all, if a bridge or culvert supports a roadway over flowing water, such structure must provide for a maximum design flow which will increase the overall diameter and height of the structure in accordance with maximum predicted flow requirements. Given the curved nature of such a structure, at any location in an arch and in the upper half of an elliptical or cylindrical structure, rising water flow levels must pass through a steadily reducing flow region. Thus the overall flow area of the structure and its height must be greater than what such dimensions would be if the structure were rectilinear. Secondly, and perhaps more importantly, such devices, as noted above, require backfill and cover which can increase the height of the supported surface over the watercourse or other obstacle by several feet. The necessity for cover may thus substantially increase the overall cost of the bridge or culvert installation since approaches on either side must then frequently be constructed in order to raise the surface of the roadway smoothly and evenly to the maximum height of the overpass from the surrounding terrain.

Various concrete and corrugated metal culverts, bridges and arch bridges are known in the prior art. Typically, concrete culverts include a plurality of abutting sections such as disclosed in U.S. Pat. Nos. 1,130,508 and 1,184,634. Reinforcing bar is commonly used in such concrete devices as disclosed in U.S. Pat. Nos. 1,412,616 and 1,860,533. Structures which may be generally categorized as rectilinear have also been suggested in the prior art. Various configurations with integral catch basins such as disclosed in U.S. Pat. No. 1,870,156 or culverts constructed of sections of concrete slabs as shown in U.S. Pat. No. 1,662,714 are known. Arch constructions are disclosed in U.S. Pat. Nos. 3,482,406 and 4,211,504, the latter being fabricated of corrugated metal. Generally, each of the designs disclosed in the foregoing patents is subject to at least one of the requirements or drawbacks delineated above with regard to prior art devices generally. This suggests that improvements in the design of concrete culverts and bridges can be made.

SUMMARY OF THE INVENTION

The instant invention is directed to a rectilinear concrete bridge or culvert structure. The structure comprises only three sides: a top and two parallel sidewalls cast as an integral unit. The structure also includes and is set upon a pair of parallel cast-in-place or preformed footers or existing supports. Preferably, the footers include a channel on the upper surface which receives and laterally stabilizes the sidewall. A haunch is preferably disposed in each internal corner to assist distribution of the load placed upon the upper, horizontal surface of the culvert. On smaller size culverts, the haunch extends downward and inward from the inside corners approximately one foot and the surface of the haunch is therefore disposed at a 45° angle. The inward extent of a haunch may be increased in proportion to the total width of the span. For example, on spans greater than approximately 12 feet, it is suggested that the haunch extend inwardly approximately two feet. The haunch may also define a curved surface. The bottom of the culvert is open and thus a creek or other flow of water may be left in its natural watercourse. The absence of a bottom significantly reduces the likelihood of debris collection and flow obstruction as water borne debris passes through the culvert. The structure is cast in mating sections of concrete and may be reinforced with conventional reinforcing bar, welded wire fabric or both. Such construction permits ready end-to-end installation of culvert sections such that any total culvert width may be readily achieved. The overall construction and design also is relatively insensitive to backfill, soil conditions and backfill techniques. The instant culvert structure also requires no cover but can receive road surface material directly upon its upper surface.

It is thus an object of the instant invention to provide a three-sided, rectilinear concrete culvert structure.

It is a further object of the instant invention to provide a three-sided, rectilinear, precast concrete culvert structure which may be cast in a plurality of mating culvert sections.

It is a still further object of the instant invention to provide a three-sided, rectilinear concrete culvert structure through which water flow may be permitted to move in its natural watercourse.

It is a still further object of the instant invention to provide a three-sided, rectilinear concrete culvert structure for disposition upon footers having a channel formed in their upper surfaces for receiving the lower portion of the sidewalls of the structure.

It is a still further object of the instant invention to provide a three-sided, rectilinear concrete culvert structure which is relatively insensitive to backfill materials and techniques and which may directly receive road surface material thereon.

Further objects and advantages of the instant invention will become apparent by reference to the following description of the preferred embodiment and appended drawings.

DESCRIPTION OF THE PREFERRED EMBODIMENT

Figure 1:
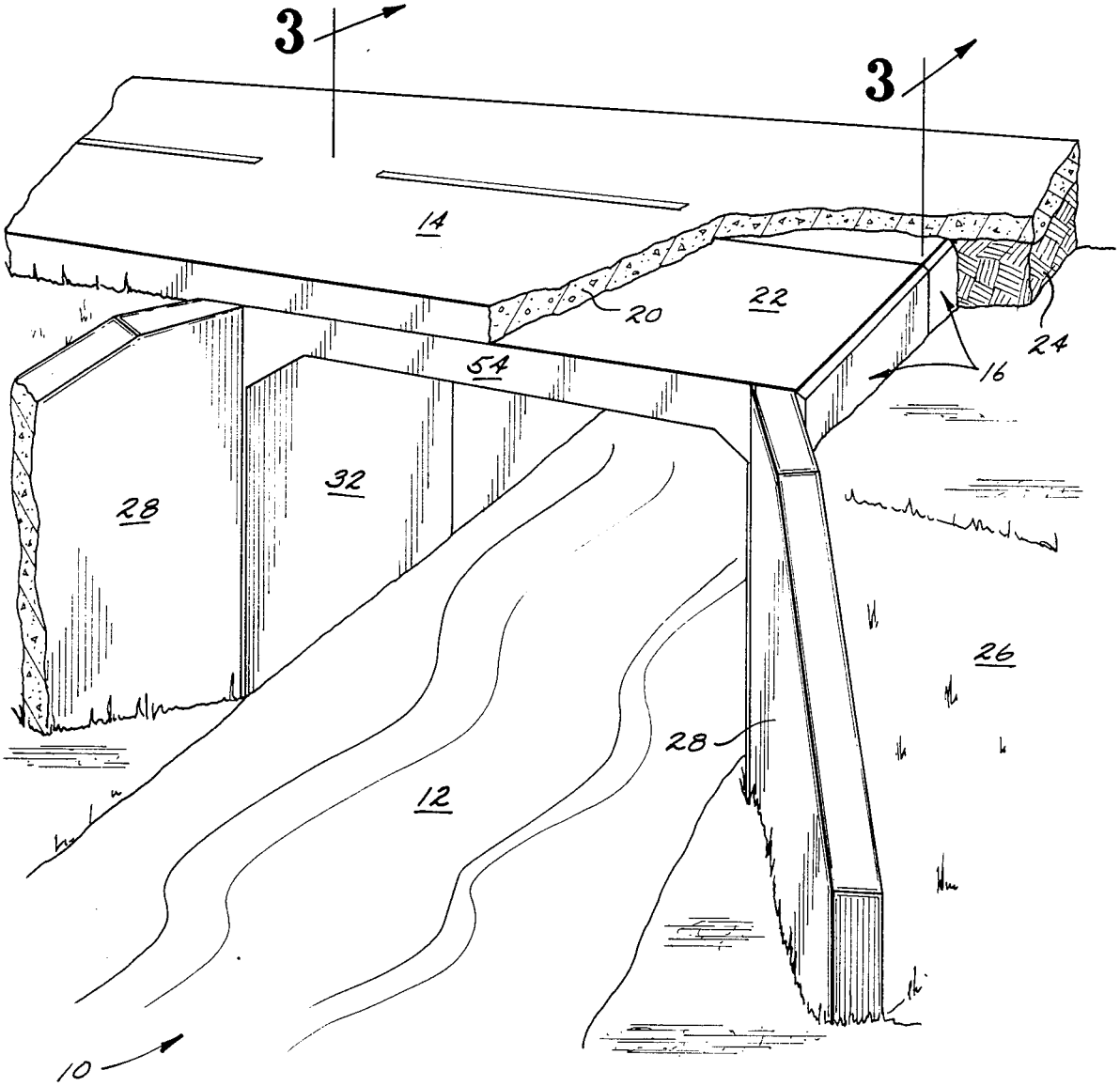
FIG. 1 is a perspective view with portions broken away of an installed rectilinear culvert structure according to the instant invention.

Referring now to FIG. 1, a rectilinear culvert assembly according to the instant invention is illustrated and generally designated by the reference numeral 10. The culvert assembly 10 may be disposed to span a river or other watercourse 12 or similar obstacle over which a planar pathway or thoroughfare 14 for vehicular or pedestrian traffic or another purpose is desired. The culvert assembly 10 includes a plurality of rectilinear culvert structures 16 placed end-to-end to provide the necessary width to support the associated thoroughfare 14. As FIG. 1 makes manifest, the thoroughfare 14 which may be fabricated of a suitably serviceable material such as concrete or asphalt 20 may be placed directly upon the upper horizontal surface 22 of the culvert assembly 10 as will be more fully described subsequently. The concrete or asphalt 20 of the thoroughfare 14 may be supported by a suitably compacted and prepared base 24 as those familiar with such construction practices will readily understand and appreciate. The base 24 in turn is supported by and the culvert assembly 10 is surrounded by backfill or soil 26. A typical rectilinear culvert assembly 10 may also include oblique flow deflectors or wing walls 28 disposed in pairs at opposite ends of the culvert assembly 10 to direct and deflect the flow of water in the watercourse 12 through the culvert assembly 10.

Figure 3:
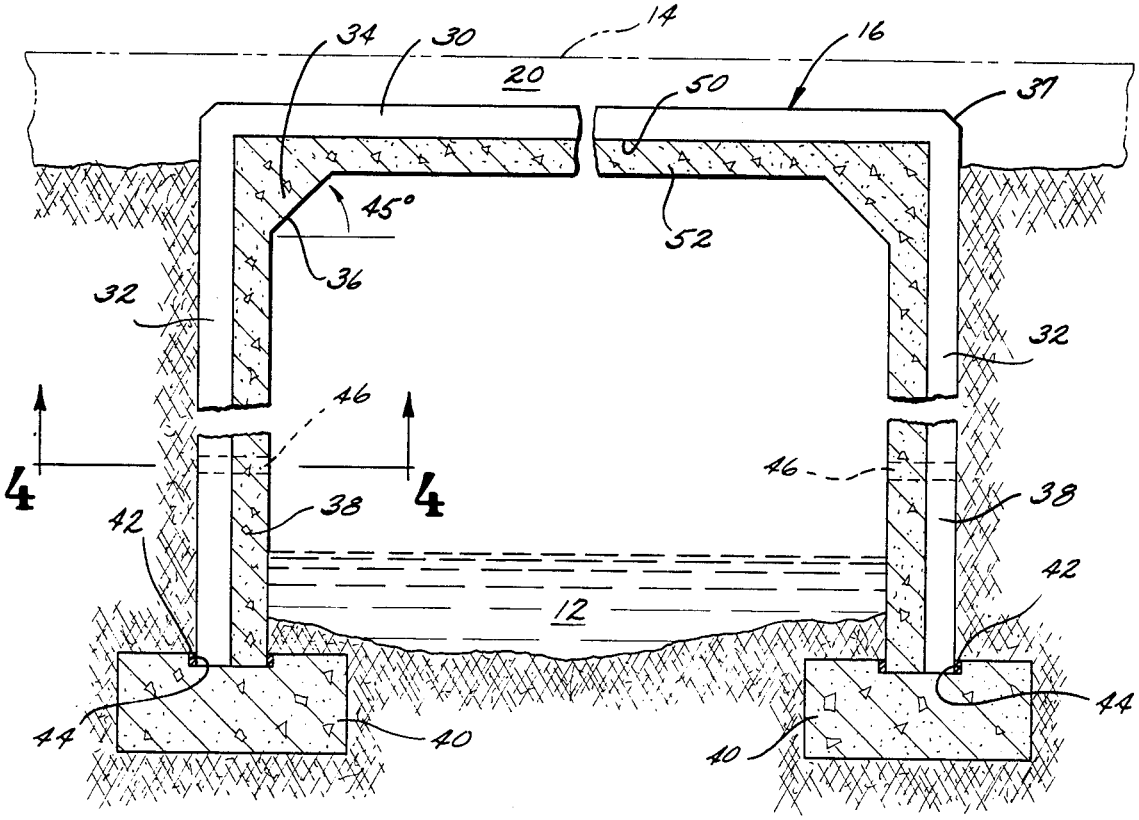
FIG. 3 is a full, sectional view of a culvert structure according to the instant invention taken along line 3—3 of FIG. 1.
Figure 4:
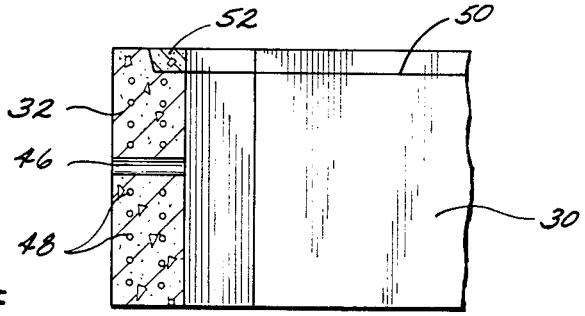
FIG. 4 is a plan view of a culvert structure according to the instant invention.

Referring now to FIGS. 3 and 4, the rectilinear culvert structure 16 is seen to include a horizontal top slab 30 which spans and interconnects a pair of sidewalls 32 which are preferably vertically oriented and thus parallel to one another. If desired, however, the sidewalls 32 may be oriented at a small acute angle, as great as approximately 10°, from the vertical. In the preferred embodiment then, the sidewalls 32 are disposed at right angles to the top slab 30 and at the intersection of each of the sidewalls 32 with the top slab 30, on the inside, is a haunch 34. Preferably, each of the haunches 34 forms an isosceles triangle having a surface 36 disposed at approximately a 45° angle. Other haunch shapes, i.e., cross sections, may be utilized, however, as explained subsequently. The haunches 34 extend vertically and horizontally along the inner surfaces of the culvert structure 16 about one foot. Preferably, the outside corner of the intersecting top slab 30 and sidewalls 32 includes a bevelled edge 37. The lower ends 38 of the sidewalls 32, opposite the top slab 30, are not connected but are freestanding and rigidly spaced-apart. The lower ends 38 are received within suitable footers 40 preferably having a channel 42 disposed in their upper surfaces. The channels 42 are intended primarily to maintain proper lateral position of the entire culvert structure 16 in contrast to providing stabilization of each sidewall 32. The channels 42 are therefore not a necessary feature. The footers 40 may either be cast in place, or be placed on existing footers or walls or may comprise a plurality of precast sections of suitable dimensions having the channel 42 for receiving the ends 38 of the culvert structures 16. Alternatively, the lower ends 38 may be placed on existing footers, walls or the like (not illustrated) remaining from a previous bridge or similar structure which, as noted above, may or may not include the channels 42. Each area immediately adjacent the intersection of the sidewalls 32 and footers 40 may be filled with grout or mastic 44 disposed in an arcuately surfaced fillet. In each of the sidewalls 32 at a height above the proposed level of the watercourse 12 may be disposed a through weephole 46 which facilitates drainage of the soil 26 adjacent the sidewalls 32 into the watercourse 12. Welded wire fabric or reinforcing bars 48 are utilized and disposed according to conventional practice. The culvert structure is preferably concrete and is fabricated through the use of conventional demountable wood or steel forms according to conventional practice.

The culvert structures 16 preferably include interengaging recesses 50 and projections 52 or similar tongue and groove structures which extend uniformly along opposed faces of the top slab 30 and sidewalls 32. The recess 50 of one structure 16 receives the projection 52 of an adjacent structure 16 as illustrated in FIG. 1 and aligns and maintains the alignment of adjacent structures 16. The recesses 50 and projections 52 are, however, optional and culvert structures 16 without such elements are deemed to be an included variation of the instant invention. Alternatively, on the exposed face 54 of the end structures of a plurality of culvert structures 16 in an assembly 10 may be fabricated without either a recess 50 or a projection 52 for aesthetic considerations or to facilitate attachment of guardrails or other structures, if desired.

With regard to such fabrication, the thicknesses of the top slab 30 and sidewalls 32 relative to the height and span of a given culvert structure 16 may be made in accordance with suitable structural guidelines such as those given in standard C 850-81, a standard Specification for Precast Reinforced Concrete Box Sections for Culverts, Storm Drains and Sewers with less than Two Feet of Cover Subjected to Highway Loadings published by ASTM. For example, in a culvert structure 16 having a span of six feet and a height of three feet, the thickness of the top slab 30 should be eight inches and the thicknesses of the walls 32 should be seven inches. In a culvert structure 16 having a span of 10 feet and a rise of five feet, both the top slabs 30 and the sidewalls 32 should be 10 inches in thickness. Greater spans and heights require corresponding increases in the thickness of the top slab 30 and sidewalls 32 and the above-noted ASTM Specification is hereby incorporated by reference. With regard to the actual rise and span of the culvert structures 16, it should be appreciated that the rise may be varied up to the span dimension with twelve foot spans and may be as low as one foot. The maximum length of each culvert structure 16 is preferably about eight feet. The culvert structures 16 are preferably cast in demountable steel forms according to standard techniques in order to maintain dimensional accuracy.

Figure 2:
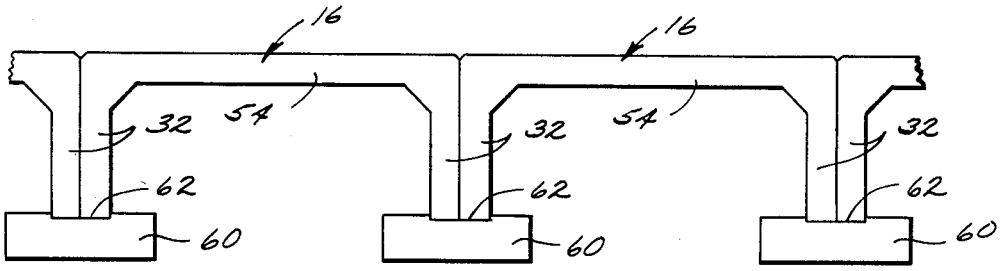
FIG. 2 is a diagrammatic view of a plurality of culvert structures according to the instant invention arranged in side-to-side manner.

Referring now to FIG. 2, a plurality of culvert structures 16 are arranged in side-by-side disposition and disposed on wider footings 60 having channels 62 disposed on their upper surfaces suitable for receiving a pair of adjacently disposed intimately contacting sidewalls 32. So arranged, it should be apparent that no void or fill is required between the parallel sidewalls 32 of adjacent culvert structure 16. It should also be apparent that in combination with the side-to-side arrangement illustrated in FIG. 2, culvert structures 16 so arranged may also be placed end-to-end as illustrated in FIG. 1 to extend not only the length but the width of the total assembly of culvert structures 16. In this assembly also, for aesthetic reasons, the exposed ends or faces 54 of the culvert structures 16 may be planar whereas for structural and alignment reasons, the adjacent ends of the culvert structure 16 will preferably include recesses 50 and projections 52 as illustrated in FIG. 4.

Figure 5:
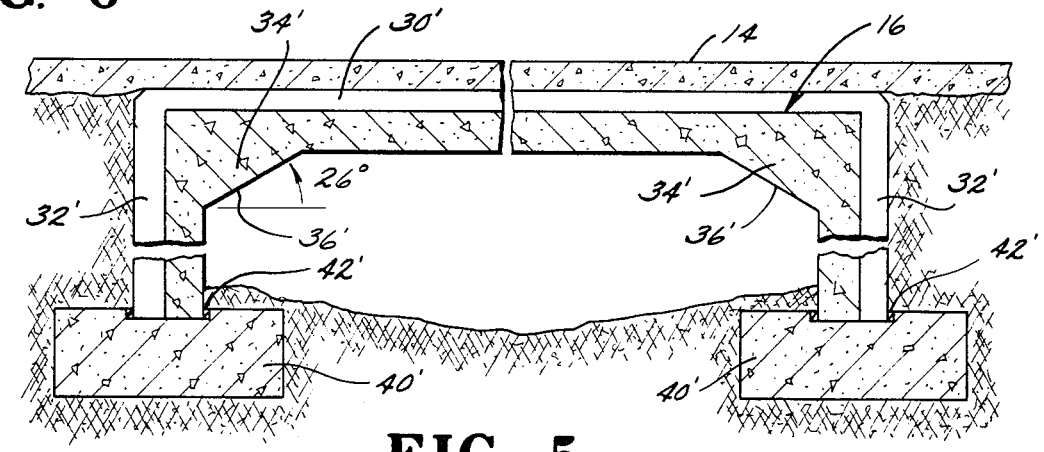
FIG. 5 is a side, elevational view of a first alternate embodiment of a culvert structure according to the instant invention in partial section illustrating enlarged haunches for use on culverts wider than about 12 feet.

Referring now to FIG. 5, a first alternate embodiment of a culvert structure 16 is illustrated and designated by the reference numeral 16'. In the alternate embodiment culvert structure 16' having a span of approximately 12 feet and greater, the proportions of the haunch 34' are preferably modified such that the face 36' of the haunch 34 is disposed at an angle of approximately 26 degrees. Typically the haunches 34' extend horizontally about two feet and vertically about one foot along the inner surfaces of the culvert structure 16. It will again be appreciated that footers 40' having a channel 42' disposed in their upper surfaces for receiving the lower portion of the sidewalls 32' will be utilized. FIG. 5 also illustrates the minimum height feature of the instant invention. Inasmuch as the top slab 30' is flat, the vertical distance of the surface of the thoroughfare 14 above, for example, the upper surface of the watercourse 12' may be a minimum dimension which is significantly less than that of prior art designs such as arch structures.

Figure 6:
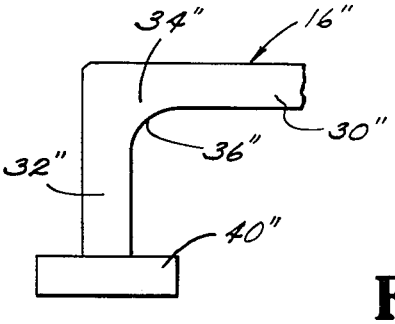
FIG. 6 is a fragmentary, side elevational view of a second alternate embodiment of a culvert structure according to the instant invention utilizing a curved haunch.

Referring now to FIG. 6, a second alternate embodiment of a culvert structure 16 is illustrated and designated by the reference numeral 16''. The second alternate embodiment culvert structure 16'' includes a top slab 30'' and vertically oriented sidewalls 32'' disposed upon footers 40'', one each of which is illustrated in FIG. 6. The second alternate embodiment culvert structure 16'' is similar to the preferred embodiment culvert structure 16 and the first alternate embodiment culvert structure 16'' in all respects such as configuration, design and assembly details and size and load capabilities. Distinct from the other embodiments, however, is the configuration of the haunch 34''. Here, the haunch 34'' rather than being triangular in cross section defines a fillet having a curved face 36'' which smoothly joins the horizontal and vertical inner surfaces of the top slab 30'' and sidewall 32''. The face 36'' may, in cross section, define a quadrant of a circle, a portion of an ellipse or other regular or irregular curve which smoothly joins the inner surfaces of the culvert structure 16''.

Several features and advantages of the instant invention will now be discussed and described with reference to the drawing figures. First of all, it should be noted that the instant culvert structure 16 may be utilized with zero cover. That is, as illustrated in FIG. 1, it is permissible to pave directly over the top surface 22 of the top span 30 without intermediate fill of any type. It should also be understood, however, that significant fill, in instances where the watercourse or other obstacle and culvert structure 16 are a significant distance below the surface of the thoroughfare 14, is equally appropriate. Since the sidewalls 32 accept and carry the load of the top span 30 in substantially only a vertical direction down to the footers 40, there are no significant laterally directed forces in the sidewalls 32 and thus the backfill adjacent the sidewalls 32 and its method of compaction, from the standpoint of the culvert structure 16 is not critical. This feature is in marked distinction to metal, corrugated culverts and concrete and metal arches wherein appropriate selection and compaction of backfill is critical to the serviceability of the culvert.

The vertical position of the watercourse 12 relative to the sidewalls 32 and footers 40 is largely a matter of choice. Generally speaking, the bottom or bed of the watercourse 12 should not be below the lower portion of the footers 40 when the sidewalls 32 and footers 40 are or may readily be exposed to the water flow as illustrated in FIG. 3. However, it should be apparent that, for example, culvert structures 16 having a wide span relative to the width of the watercourse 12 such that the footers 40 are remote from the watercourse 12, permit the stream bed to be well below the footers 40. FIG. 3 therefore represents but one of the vertical arrangements of such features.

Since the culvert lacks a bottom portion, flow through it is unimpeded by such a structure and furthermore, cleaning of debris and of the watercourse 12 itself is greatly simplified.

The instant culvert design also enjoys a significant weight and thus material and cost reduction over conventional box culvert constructions. Such weight, material and cost reductions devolve directly from the elimination of the bottom, horizontal portion of the culvert. Since culverts are typically arranged such that their longer dimension is horizontal and since one of the longer, horizontal portions has been eliminated by the instant invention, the weight reduction enjoyed is typically at least 25% and generally greater. The following table relates typical weight reductions of the instant invention relative to a conventional four wall standard box culvert.

| Nom. Size (Feet) | Approx. Weight St'd Box Culvert (Lbs./Lin. Ft.) | Approx. Weight 3 Wall Structure (Lbs./Lin. Ft.) |
|---|---|---|
| 10 × 5 | 4400 | 2900 |
| 10 × 7 | 4900 | 3460 |
| 10 × 10 | 5650 | 4240 |
| 12 × 6 | 6300 | 4050 |
| 12 × 8 | 6900 | 4830 |
| 12 × 12 | 8100 | 6070 |

From the foregoing specification, particularly the above table and the drawings, it can be appreciated that the elimination of the lower segment of a culvert structure provides economies in material expense, weight and transportation costs as well as attendant installation benefits. The primary function performed by the lower culvert segment which has been eliminated is now performed by the remaining elements. Specifically, rigid stabilization and maintenance of the positions of the sidewalls by additional structures have been rendered unnecessary due to the design and rectilinear configuration of the culvert structure 16. Again, it should be emphasized that the channels 42 in the footers 40 do not primarily provide sidewall stabilization as does the lower segment of a prior art culvert but rather simply staticly locate the entire culvert structure 16. The channels 42 are therefore preferable, though optional. It will thus be appreciated that the function of the lower segment of a four sided or elliptical culvert structure is performed in the instant invention by only three segments, namely, the tob slab 30 and two vertical sidewalls 32.

The foregoing disclosure is the best mode devised by the inventors for practicing this invention. It is apparent, however, that structures incorporating modifications and variations will be obvious to one skilled in the art of concrete structures. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. A bottomless concrete culvert assembly comprising, in combination, at least one unitary, rectilinear culvert structure and a pair of footers, said culvert structure having only one substantially planar span and a pair of parallel sidewalls integrally and rigidly formed with and extending substantially perpendicularly from said planar span, one each of said footers disposed in supporting relationship with a respective one of said sidewalls.

2. The culvert assembly of claim 1 wherein each of said footers includes means for laterally restraining said sidewalls of said assembly.

3. The culvert assembly of claim 2 wherein said lateral restraining means includes a channel on an upper surface of said footers for receiving one of said sidewalls.

4. The culvert assembly of claim 1 further including a pair of haunches, one of said pair of haunches disposed at each of a respective one of a pair of inside intersections of said sidewalls and said span and extending at least farther along said span than along said sidewalls.

5. The culvert assembly of claim 4 wherein said haunches are triangular in cross section.

6. A bottomless concrete culvert assembly comprising, in combination, at least one unitary, rectilinear culvert structure having only one substantially planar span and a pair of sidewalls, said sidewalls being integrally formed with and extending unidirectionally and substantially perpendicularly from said span, a pair of haunches, one of said haunches disposed at each of a respective one of a pair of inside intersections of said sidewalls and said span, and a pair of footers, each of said footers disposed in supporting relationship with a respective one of said sidewalls and including means on an upper surface for receiving a respective one of said sidewalls.

7. The culvert assembly of claim 6 wherein said means on said footers includes a channel on its upper surface for receiving a respective one of said sidewalls.

8. The culvert assembly of claim 6 wherein said culvert structure further includes a bevelled edge at the outside intersection of each of said sidewalls and said span.

9. The culvert assembly of claim 6 further including a pair of through apertures, one of said apertures disposed in a respective one of each of said sidewalls.

10. The culvert assembly of claim 6 wherein said channel in said footers is slightly wider than the width of said one of said sidewalls received therein.

11. The culvert assembly of claim 6 further including road surface material disposed directly on a surface of said span.

12. The culvert assembly of claim 6 further including a pair of angled, planar flow deflectors disposed adjacent and at an angle to a respective one of said pair of vertical sidewalls.

13. The culvert assembly of claim 6 wherein said culvert structure includes a uniform recess on an end of said structure, said uniform recess extending across said horizontal span and along said vertical sidewalls.

14. The culvert assembly of claim 6 wherein said culvert structure includes a uniform projection on an end of said structure, said uniform projection extending across said horizontal span and along said vertical sidewalls.

15. The culvert assembly of claim 6 wherein said haunches are triangular in cross section and extend along said span a distance greater than they extend along said sidewalls.

16. A bottomless concrete culvert assembly comprising, in combination, at least one unitary, rectilinear culvert structure having only one substantially planar span portion, and a pair of parallel, sidewalls integrally formed with and extending perpendicularly and unidirectionally from said span portion and a pair of haunches disposed at inside intersections of said sidewalls and said span portion, and a pair of footers, one each of said footers disposed in supporting relationship with a respective one of said sidewalls, each of said footers including a channel on its upper surface for receiving and restraining said sidewalls against movement along a first axis and permitting movement of said sidewalls along a second axis normal to said first axis wherein the media spanned by said assembly may remain substantially in its course.

17. The culvert assembly of claim 16 further including a plurality of said unitary culvert structures disposed in aligned relationship on a plurality of said footers and wherein at least one of said channels on said footers is at least twice as wide as the width of said sidewalls and said twice wide channel receives two of said sidewalls in side-to-side juxtaposition.

18. The culvert assembly of claim 16 wherein said haunches are triangular in cross section.

19. The culvert assembly of claim 16 wherein said haunches extend along said span portion at least twice as far as they extend along said sidewalls.

20. A bottomless modular concrete culvert assembly comprising, in combination, at least two unitary rectilinear culvert structures and a pair of footers, said culvert structures having only one substantially planar span, a pair of parallel sidewalls integrally and rigidly formed with and extending substantially perpendicularly from said planar span, one of said footers disposed in supporting relationship with a respective one of said sidewalls and said culvert structures disposed in aligned end-to-end juxtaposition.

21. A bottomless modular concrete culvert assembly comprising, in combination, at least two unitary rectilinear culvert structures having only one substantially planar span and a pair of sidewalls, said sidewalls being integrally formed with and extending unidirectionally and substantially perpendicularly from said span, a pair of haunches, one of said haunches disposed at each of a respective one of a pair of inside intersections of said sidewalls and said span, and a pair of footers, one of said footers disposed in supporting relationship with a respective one of said sidewalls and including means on an upper surface for receiving a respective one of said sidewalls and said culvert structures disposed in aligned end-to-end juxtaposition.

22. The culvert assembly of claim 20 further including a pair of haunches, one of said haunches disposed at each of a respective one of a pair of inside intersections of said sidewalls and said span of each of said culvert structures and extending at least farther along said span than along said sidewalls.

23. The culvert assembly of claim 21 wherein said haunches each extend along said span a distance greater than they extend along said sidewalls.

24. The culvert assembly of claim 16 wherein at least two culvert structures are disposed in end-to-end juxtaposition.

* * * * *

REEXAMINATION CERTIFICATE (1022nd)

United States Patent [19] [11] B1 4,564,313

Niswander et al. [45] Certificate Issued Mar. 7, 1989

[54] RECTILINEAR CULVERT STRUCTURE

[75] Inventors: Robert L. Niswander; Tomy W. Cornwell, both of Findlay, Ohio

[73] Assignee: Hyway Concrete Pipe Company, Inc., Findlay, Ohio

Reexamination Request:
No. 90/001,366, Oct. 30, 1987

Reexamination Certificate for:

| | |
|---|---|
| Patent No.: | 4,564,313 |
| Issued: | Jan. 14, 1986 |
| Appl. No.: | 537,337 |
| Filed: | Sep. 29, 1983 |

[51] Int. Cl.[4] ..... E01F 5/00

[52] U.S. Cl. ..... 405/125; 249/11; 405/124

[58] Field of Search ..... 405/124, 125, 126

[56] References Cited

U.S. PATENT DOCUMENTS

| | | | |
|---|---|---|---|
| 392,094 | 10/1888 | Barnes | 405/124 |
| 494,576 | 4/1893 | Lewis | 405/125 |
| 997,382 | 7/1911 | Foster | 405/125 |
| 1,130,508 | 3/1915 | Hall | 405/125 |
| 1,144,200 | 6/1915 | Hewett | 405/125 |
| 1,184,634 | 5/1916 | Duerrwachter | 405/126 X |
| 1,412,616 | 4/1922 | Kammerer | 405/126 |
| 1,662,714 | 3/1928 | Morgan | 405/124 |
| 1,860,533 | 5/1932 | Fredenhagen | 405/124 |
| 1,870,156 | 8/1932 | Wheeler | 405/124 |
| 2,041,267 | 5/1936 | Schroeder | 405/125 |
| 2,265,871 | 12/1941 | Scott | 249/12 |
| 3,482,406 | 12/1969 | Schuppisser et al. | |
| 3,693,927 | 9/1972 | Jennings | 249/11 |
| 3,696,177 | 10/1972 | Holland | 249/11 X |
| 4,314,775 | 2/1982 | Johnson | 405/155 |
| 4,558,969 | 12/1985 | FitzSimons | 405/124 |

FOREIGN PATENT DOCUMENTS

| | | | |
|---|---|---|---|
| 2306401 | 8/1974 | Fed. Rep. of Germany | 249/11 |

OTHER PUBLICATIONS

Ready-To-Pour Concrete Company brochure, published prior to 1970.

*Primary Examiner*—Dennis L. Taylor

[57] ABSTRACT

A three-sided, rectilinear bridge or culvert structure comprises a pair of vertical sidewalls set in preformed or cast in place footers or existing supports and an integral, planar, horizontal span. The footers preferably include a sidewall receiving channel on their upper surfaces. There is no lower or bottom portion of the structure such as is found in conventional box culverts and thus, that region between the footers and sidewalls is open and readily permits water flow through the structure in its natural watercourse, lessening the likelihood of debris collection within the structure. The structure is cast concrete reinforced with conventional reinforcing bar or welded wire mesh. A wide range of rise/span (height/width) proportions may be accommodated in structures having spans up to about thirty feet.

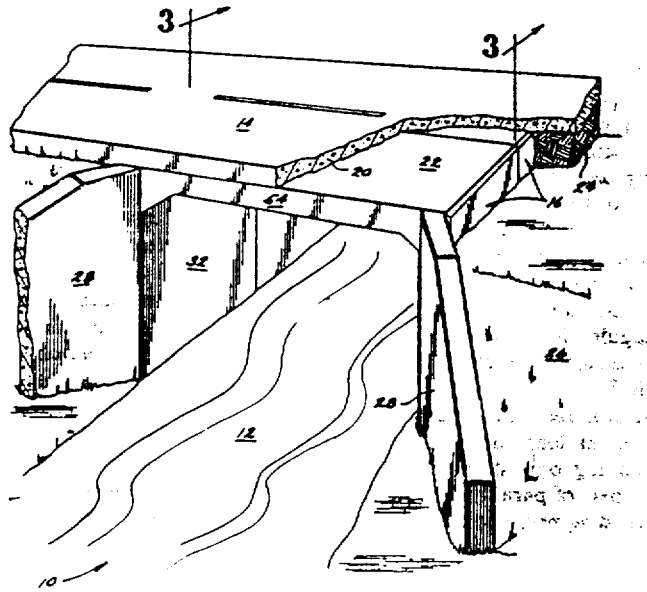

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4, 18, 19, 22 and 23 are cancelled.

Claims 1, 5, 6, 15, 16, 20 and 21 are determined to be patentable as amended.

Claims 2, 3, 7–14, 17 and 24, dependent on an amended claim, are determined to be patentable.

New claims 25–29 are added and determined to be patentable.

1. A bottomless concrete culvert assembly comprising, in combination, at least one unitary, rectilinear culvert structure and a pair of footers, said culvert structure having only one substantially planar span and a pair of parallel sidewalls integrally and rigidly formed with and extending substantially perpendicularly from said planar span, *a pair of haunches, one of said pair of haunches disposed at each of a respective one of a pair of inside intersections of said sidewalls and said span and extending farther along said span than along said sidewalls,* one each of said footers disposed in supporting relationship with a respective one of said sidewalls.

5. The culvert assembly of claim [4] *1* wherein said haunches are triangular in cross section.

6. A bottomless concrete culvert assembly comprising, in combination, at least one unitary, rectilinear culvert structure having only one substantially planar span and a pair of sidewalls, said sidewalls being integrally formed with an extending unidirectionally and substantially perpendicularly from said pan, a pair of haunches, one of said haunches disposed at each of a respective one of a pair of inside intersections of said sidewalls and said span, *the ratio of the length of each of said haunches across said span to the height of said each of said haunches along one of said sidewalls being greater than one,* and a pair of footers, each of said footers disposed in supporting relationship with a respective one of said sidewalls and including means on an upper surface for receiving a respective one of said sidewalls.

15. The culvert assembly of claim 6 wherein said haunches are triangular in cross section [and extend along said span a distance greater than they extend along said sidewalls].

16. A bottomless concrete culvert assembly comprising, in combination, at least one unitary, rectilinear culvert structure having only one substantially planar span portion, and a pair of parallel, sidewalls integrally formed with an extending perpendicularly and unidirectionally from said span portion and a pair of haunches disposed at inside intersections of said sidewalls and said span portion, *said haunches having a triangular cross section and extending farther along said span than along said sidewalls,* and a pair of footers, one each of said footers disposed in supporting relationship with a respective one of said sidewalls, each of said footers including a channel on its upper surface for receiving and restraining said sidewalls against movement along a first axis and permitting movement of said sidewalls along a second axis normal to said first axis wherein the media spanned by said assembly may remain substantially in its course.

20. A bottomless modular concrete culvert assembly comprising, in combination, at least two unitary rectilinear culvert structures and a pair of footers, said culvert structures having only one substantially planar span, a pair of parallel sidewalls integrally and rigidly formed with and extending substantially perpendicularly from said planar span, *a pair of haunches, one of said haunches disposed at each of a respective pair of inside corners of said span and said sidewalls, each of said haunches extending farther across said span than along an adjacent one of said sidewalls,* one of said footers disposed in supporting relationship with a respective one of said sidewalls and said culvert structures disposed in aligned end-to-end juxtaposition.

21. A bottomless modular concrete culvert assembly comprising, in combination, at least two unitary rectilinear culvert structures having only one substantially planar span and a pair of sidewalls, said sidewalls being integrally formed with and extending unidirectionally and substantially perpendicularly from said span, a pair of haunches, one of said haunches disposed at each of a respective one of a pair of inside intersections of said sidewalls and said span, *each of said haunches defining the ratio of the width of said haunch across said span to the height of said haunch along an adjacent said sidewall as greater than one,* and a pair of footers, one of said footers disposed in supporting relationship with a respective one of said sidewalls and including means on an upper surface for receiving a respective one of said sidewalls and said culvert structures disposed in aligned end-to-end juxtaposition.

*25. A bottomless concrete culvert assembly comprising, in combination, a three panel unitary rectilinear culvert structure having a single substantially planar span and a pair of integral sidewalls extending unidirectionally and substantially perpendicularly from said span, a pair of integral haunches, one of said pair of haunches disposed at each of a respective one of a pair of inside corners of said sidewalls and said span, each of said haunches extending a greater distance along said span than along said sidewall, and a pair of footers, each of said footers disposed in supporting relationship with a respective one of said sidewalls.*

*26. The bottomless concrete culvert assembly of claim 25 wherein said haunches extend at least twice as far along said span as along said sidewall.*

*27. The bottomless concrete culvert assembly of claim 25 wherein said haunches define an scalene triangle.*

*28. The bottomless concrete culvert assembly of claim 25 wherein said footers include means on an upper surface for restraining a respective one of said sidewalls.*

*29. The bottomless concrete culvert assembly of claim 25 wherein the inside and outside surfaces of said sidewalls are parallel.*

* * * * *

US004564313B1

REEXAMINATION CERTIFICATE (2563rd)

United States Patent [19]

[11] B2 4,564,313

Niswander et al.

[45] Certificate Issued May 9, 1995

[54] RECTILINEAR CULVERT STRUCTURE

[75] Inventors: Robert L. Niswander; Tomy W. Cornwell, both of Findlay, Ohio

[73] Assignee: Hyway Concrete Products Co., Findlay, Ohio

Reexamination Request:
No. 90/003,571, Sep. 15, 1994

Reexamination Certificate for:
Patent No.: 4,564,313
Issued: Jan. 14, 1986
Appl. No.: 537,337
Filed: Sep. 29, 1983

Reexamination Certificate B1 4,564,313 issued Mar. 7, 1989.

[51] Int. Cl.[6] ..... E01F 5/00
[52] U.S. Cl. ..... 405/125; 249/11; 405/124
[58] Field of Search ..... 405/124, 125, 126; 249/10, 11, 12

[56] References Cited

U.S. PATENT DOCUMENTS 997,382 7/1911 Foster ..... 405/125
1,662,714 3/1928 Morgan ..... 405/124
1,860,533 5/1932 Fredenhagan ..... 405/124
4,558,969 12/1985 FitzSimons ..... 405/124

OTHER PUBLICATIONS

Ready to Pour Concrete Company brochure, published prior to 1970.
Handbook of Frame Constants of the Portland Cement Association ©1958.

*Primary Examiner*—Dennis L. Taylor

[57] ABSTRACT

A three-sided, rectilinear bridge or culvent structure comprises a pair of vertical sidewalls set in preformed or cast in place footers or existing supports and an integral, planar, horizontal span. The footers preferably include a sidewall receiving channel on their upper surfaces. There is no lower or bottom portion of the structure such as is found in conventinal box culverts and thus, that region between the footers and sidewalls is open and readily permits water flow through the structure in its natural watercourse, lessening the likelihood of debris collection within the structure. The structure is cast concrete reinforced with conventional reinforcing bar or welded wire mesh. A wide range of rise/span (height/width) proportions may be accommodated in structures having spans up to about thirty feet.

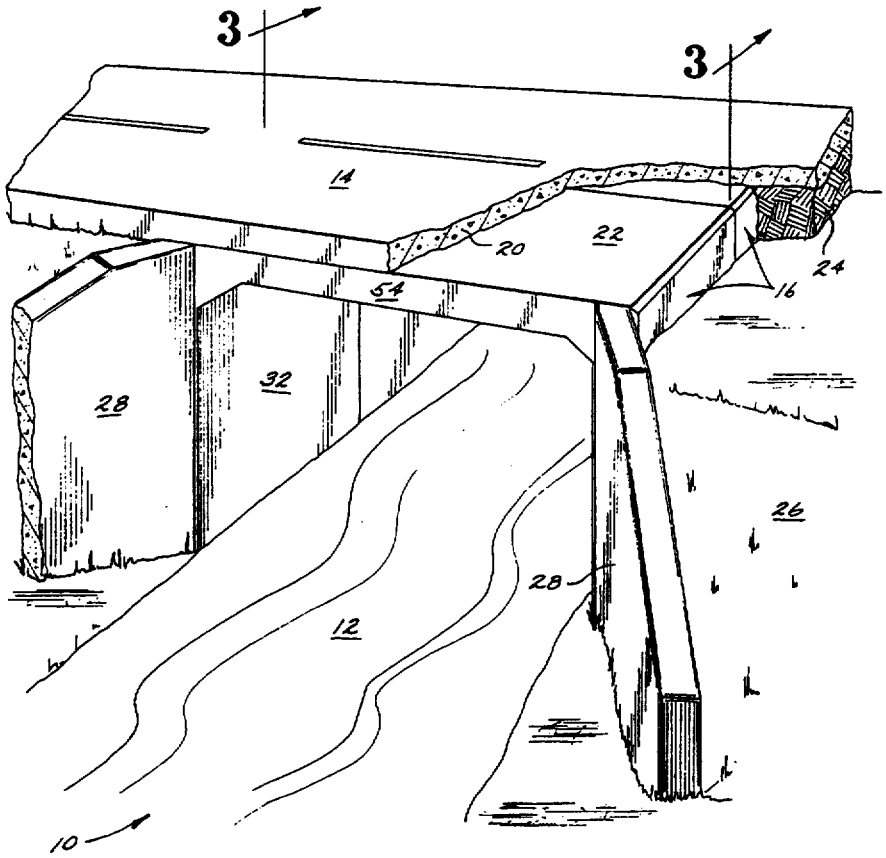

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The Patentability of claims 1—3, 5–17, 20, 21, and 24–29 is confirmed.

Claims 4, 18, 19, 22, & 23 were previously cancelled.

* * * * *